US011672329B2

(12) United States Patent
Conner et al.

(10) Patent No.: US 11,672,329 B2
(45) Date of Patent: Jun. 13, 2023

(54) PAINT BRUSH

(71) Applicants: Mitch Conner, LaCrosse, KS (US); Nikki Conner, LaCrosse, KS (US)

(72) Inventors: Mitch Conner, LaCrosse, KS (US); Nikki Conner, LaCrosse, KS (US)

( * ) Notice: Subject to any disclaimer, the term of this patent is extended or adjusted under 35 U.S.C. 154(b) by 357 days.

(21) Appl. No.: 17/077,694

(22) Filed: Oct. 22, 2020

(65) Prior Publication Data

US 2021/0037960 A1 Feb. 11, 2021

Related U.S. Application Data

(60) Provisional application No. 62/951,350, filed on Dec. 20, 2019.

(51) Int. Cl.

| | |
|---|---|
| ***B44D 3/12*** | (2006.01) |
| ***A46B 15/00*** | (2006.01) |
| ***A46B 17/06*** | (2006.01) |

(52) U.S. Cl.

CPC ..... *A46B 15/0055* (2013.01); *A46B 17/06* (2013.01); *B44D 3/12* (2013.01); *A46B 2200/202* (2013.01)

(58) Field of Classification Search

CPC ..... A46B 17/06; A46B 17/02; B44D 3/12
See application file for complete search history.

(56) References Cited

U.S. PATENT DOCUMENTS

| | | | | |
|---|---|---|---|---|
| 6,187,104 | B1 * | 2/2001 | Bozarjian | A46B 17/02 15/160 |
| 6,244,559 | B1 * | 6/2001 | Stanton | B44D 3/123 248/312.1 |
| 6,823,553 | B1 * | 11/2004 | Paredes | A46B 15/0055 7/105 |
| 8,060,971 | B1 * | 11/2011 | Castelluccio | A46B 15/0026 15/160 |
| 2003/0233719 | A1 * | 12/2003 | Wolfinger | A46B 5/00 15/159.1 |
| 2006/0265821 | A1 * | 11/2006 | Hause | A46B 15/0002 15/103.5 |
| 2009/0146022 | A1 * | 6/2009 | Paga, Jr. | B44D 3/123 220/736 |
| 2017/0007012 | A1 * | 1/2017 | Aide | B44D 3/123 |
| 2022/0258529 | A1 * | 8/2022 | Alvarez | A46B 17/06 |

OTHER PUBLICATIONS

A99 Magnetic Paint Brush clip (1pg.).
Perfect Handling (5pgs.).

* cited by examiner

*Primary Examiner* — Michael D Jennings
(74) *Attorney, Agent, or Firm* — Kenneth H. Jack; Davis & Jack, L.L.C.

(57) ABSTRACT

A paint brush incorporating a handle; the paint brush further incorporating a ferrule which is fixedly attached to the handle, the ferrule having an interior space; the paint brush further incorporating a plurality of permanent magnets mounted within the ferrule's interior space; the paint brush further incorporating a body of bristles mounted within the ferrule; wherein the permanent magnets are positioned and arranged within the ferrule so that the paint brush may utilize the lip of an opened paint can as a secure temporary resting place.

10 Claims, 5 Drawing Sheets

PAINT BRUSH

CLAIM OF PRIORITY FROM PREVIOUSLY FILED PROVISIONAL PATENT APPLICATION

This non-provisional patent application claims the benefit of and priority from U.S. Provisional Patent Application No. 62/951,350 filed Dec. 20, 2019. The co-inventors disclosed in and co-applicants of said provisional application are the same persons as the persons who are disclosed as the co-inventors and co-applicants of the instant application. The co-applicants assert that structures and functions of structures claimed in the instant application are disclosed both in the specification and in the drawings of said '350 provisional application.

FIELD OF THE INVENTION

This invention relates to paint brushes. More particularly, this invention relates to paint brushes which include special features for functioning consonantly with paint cans which are commonly present within the brushes' usage environments.

BACKGROUND OF THE INVENTION

Conventional paint brushes comprise bristles and a handle interconnected by a ferrule. Such conventional paint brushes are commonly manually wielded and utilized by a painter within a usage environment which includes and prominently features a paint can. In circumstances where the painter needs to open the paint can, and while the painter holds a conventional paint brush in one of his or her hands, the paint brush often interferes with or hinders the task of paint can opening, requiring that the painter set the paint brush aside in order to access another tool (such as a flat bladed screw driver) in order to open the paint can.

Alternatively, while the paint can is open the painter often holds in one of his or her hands a paint brush which is loaded with paint. While the paint filled brush is held, a need to access a different tool often arises. For example, the use of the painter's other hand may be dedicated to holding a ladder rung and the needed different tool may comprise a scraper in the painter's tool belt. In such circumstances, such alternate tool cannot be easily accessed without first releasing the paint brush. The circular upper lip of the paint can (which is commonly suspended or placed near the painting site) often offers a surface which the painter may attempt to utilize as a temporary paint brush resting place. However, upon an attempted placement of the paint brush on the paint can's lip, the paint brush often falls into the paint can or falls downwardly outside of the paint can. Upon successfully balancing the paint brush upon the paint can's upper lip, paint from the brush's bristles often undesirably drips outside the can.

As indicated above, conventional paint brushes in their relationship with the paint cans which are present in their usage environment produce negative and undesirable results when the can is closed and when the can is opened. The instant inventive paint brush solves or ameliorates the problems, defects, and deficiencies of common and conventional paint brushes described above by specially adapting a paint brush for alternatively opening paint cans and for securely balancing the paint brush upon the lip of an opened paint can.

BRIEF SUMMARY OF THE INVENTION

A first structural component of the instant inventive paint brush comprises a handle having a head end and a tail or base end. In the preferred embodiments, the handle component is composed of either wood or plastic.

A further structural component of the instant inventive paint brush comprises a body of or multiplicity of bristles, such body having a base end, and a multiplicity of bristle ends opposite the base.

A further structural component of the instant inventive paint brush comprises a ferrule which acts as an attachment sleeve for interconnecting the head end of the handle and the base end of the body of bristles.

The instant inventive paint brush preferably further comprises at least a first, and preferably first and second or a plurality of permanent magnets which are housed within the ferrule component.

A further preferred structural component of the instant inventive paint brush comprises a pry bar covered by a removable cap which forms base or tailend of the paint brush's handle. In such preferred embodiment, the extreme tailward end of the pry bar component is fitted for extension into the lid prying groove of the circular lid of a common paint can, while the cap is configured to replicate an end of a common paint brush handle.

In use of the inventive paint brush, a painter holding the brush's handle in one of his or her hands may easily and conveniently remove the cap to utilize the pry bar component to remove the lid from a paint can. Accordingly, the inventive paint brush obviates the necessity of time and motion wasting steps of releasing the paint brush, seeking and retrieving an alternative paint lid prying tool, utilizing such alternative tool for lid removal, returning the alternative tool to its storage place, and retrieving the paint brush. Where the bristles of the paint brush carry wet paint, the brush's ability and capacity for paint can lid prying advantageously eliminates any need for finding a suitable temporary resting place for the brush's paint loaded bristles.

In other circumstances affecting the use of the instant inventive paint brush, the paint can may be open and the paint brush may be loaded with paint. In such instances, the painter may easily and conveniently align the ferrule portion of the paint brush with the paint can's lip, causing the ferrule portion to contact and span across the concentric ridges which typically form and define the can's paint lid pry channel. Upon causing the ferrule portion of the paint brush to rest upon such ridges and to span there across, the permanent magnets mounted within the ferrule magnetically hold the ferrule and the entirety of the paint brush against the lip of the paint can, advantageously allowing the paint loaded bristles to cantilever over the interior of the paint can while the paint brush is securely held in its temporary storage location. Potentially unequal cantilevering extensions of the paint loaded bristles over the interior of the can and of the paint brush's handle in the opposite direction are advantageously maintained via the force of the magnets housed within the ferrule. While the inventive paint brush is magnetically attached to the lip of the paint can, drippings from the paint brush fall into the body of paint contained within the paint can.

Accordingly, objects of the instant invention include the provision of a paint brush which incorporates features and structures, as described above, and which arrange those structures in relation to each other in the manners described above, for the performance of the beneficial functions described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS

Figure 1:
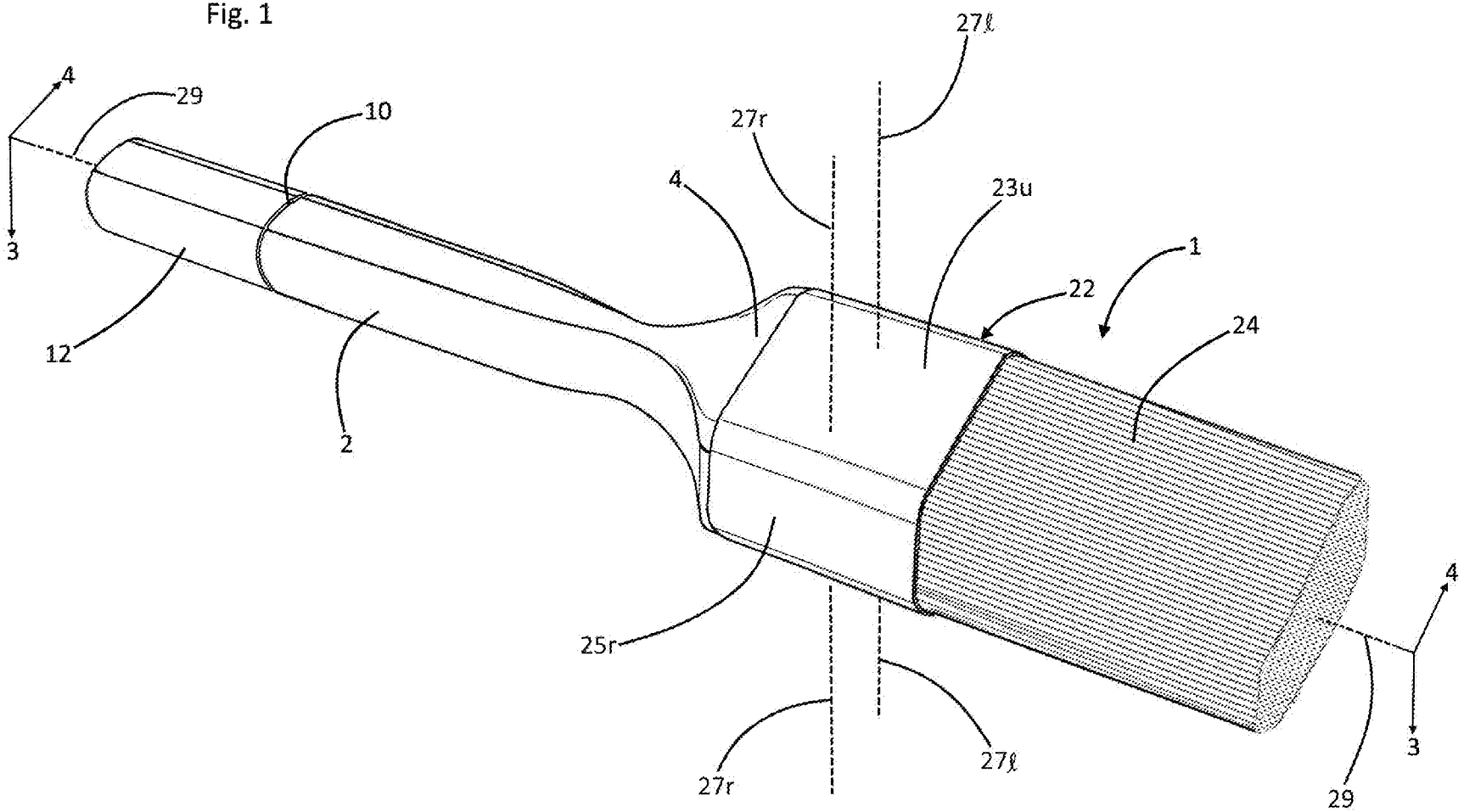
FIG. 1 is a perspective view of the instant inventive paint brush.
Figure 2:
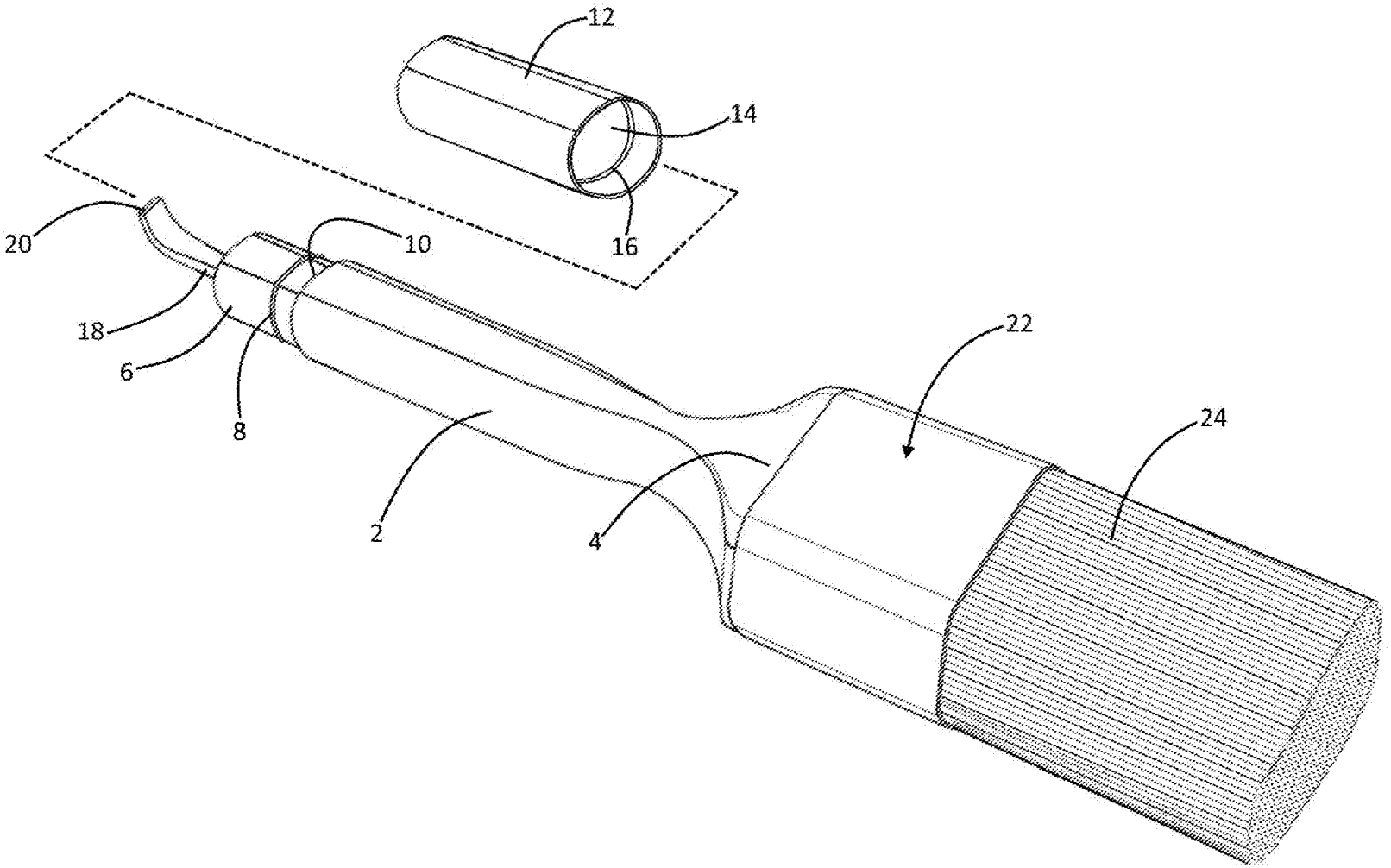
FIG. 2 redepicts the structure of FIG. 1, the view of FIG. 2 showing a pry bar cover component detached.
Figure 3:
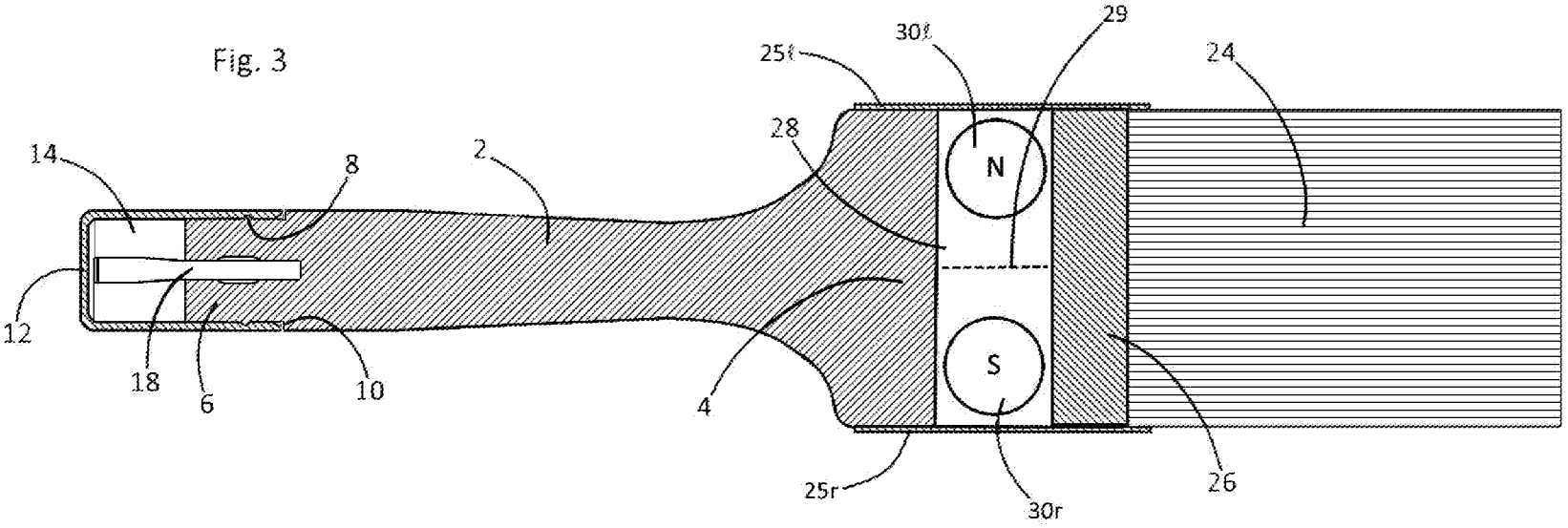
FIG. 3 is a sectional view as indicated in FIG. 1.

Referring now to the drawings and in particular to Drawing FIG. 1, a preferred embodiment of the instant inventive paint brush is referred to generally by Reference Arrow 1. The paint brush 1 comprises a handle 2 having a tail end which is leftward according to the views of Drawing FIGS. 2-4, and an opposite head end 4. In a suitable embodiment, the handle 2 is composed of durable plastic. Alternatively, the handle 2 may be composed of wood.

A further structural component of the instant inventive paint brush comprises a multiplicity of filaments or a body of bristles 24, such bristles having a base end which is secured by an epoxy binding 26.

A further structural component of the inventive paint brush comprises a ferrule or sleeve element 22 having an open base or tailward end which securely receives and holds the head end 4 of the handle 2, and which has an open opposite end which securely receives and retains the bristles' epoxy body 26.

Further structural components of the instant inventive paint brush comprise at least a first, and preferably a plurality of permanent magnets 30, such magnets comprising a leftward stack of magnets 30*l* and a rightward stack of magnets 30*r*. The magnets 30 are preferably mounted and housed within the ferrule 22 between the head end 4 of the handle 2 and the bristles' epoxy body 26. Such head end 4 and body 26 suitably define a hollow interior space 28 within which the magnets 30 are mounted. Alternatively, such space 28 may filled by a ferrule plug (not depicted within views), and the magnets 30 may be alternatively mounted within closely fitted voids (not depicted within views) formed within such plug. In the preferred embodiment, the magnets 30 comprise high strength neodymium iron boron magnets which are arranged in north/south orientations with respect to each other, as indicated by "N" and "S" notations appearing in Drawing FIGS. 3 and 4. Such alternating "N" and "S" arrangements of the magnets' poles allow the stacked magnets to operate as single magnets having enhanced magnetic strength.

The ferrule 22 has a left and right side walls 25*l* and 25*r*, and has upper and lower walls 23*u* and 23*l*. Such upper and lower walls 23*u* and 23*l* are preferably laterally widened to exceed the heights of the left and right side walls 25*l* and 25*r*. Such widening of the upper and lower walls 23*u* and 23*l* laterally oblongates the head of the paint brush 1, advantageously providing lateral stability to the paint brush 1 upon its placement onto a narrow surface, for example, referring to FIGS. 4 and 5, a paint can's lip surfaces 44 and 45.

The paint brush 1 has a longitudinal midline 29, and the left and right stacks of permanent magnets 30*l* and 30*r* are preferably mounted and positioned within the interior 28 of the ferrule 22 respectively leftwardly from and rightwardly from said longitudinal midline 29.

Figure 4:
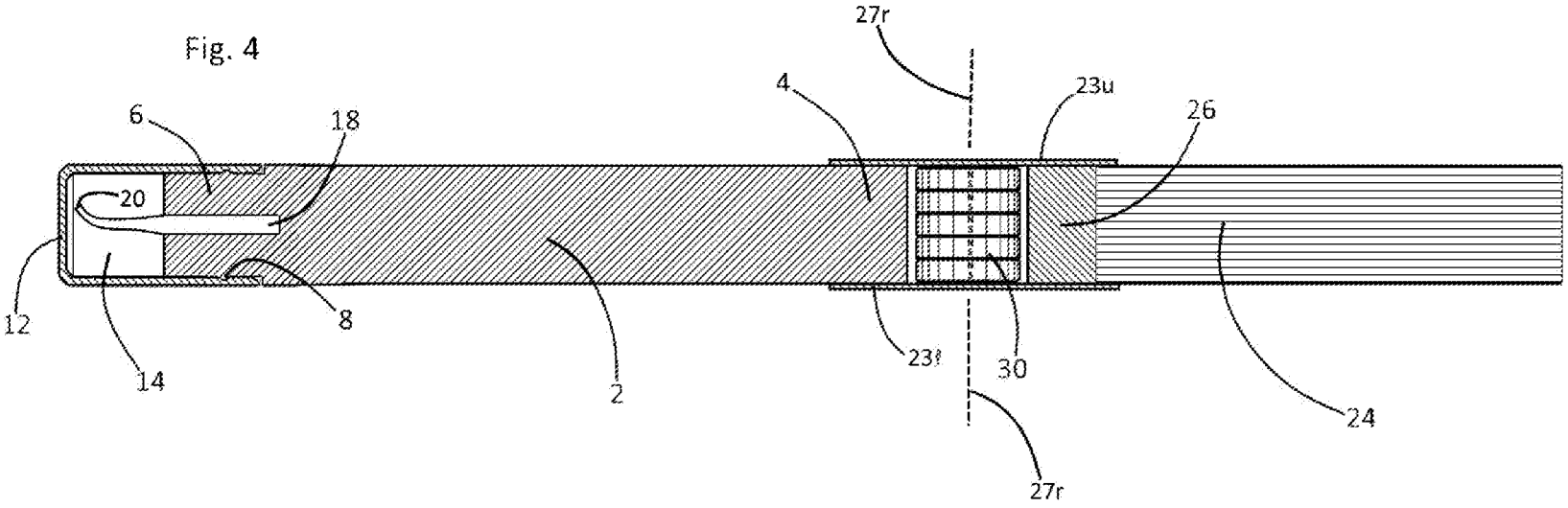
FIG. 4 is an alternative sectional view as indicated in FIG. 1.

The stacked north/south pole series arrangements of the permanent magnets 30*l* and 30*r*, as depicted in FIG. 4, advantageously orient and align the magnets' polar axes and their emitted lines of magnetic force with perpendicular left and right axes 27*l* and 27*r*. Such alignment and positioning of the magnets 30*l* and 30*r* respectively leftwardly and rightwardly from the longitudinal midline 29 causes their lines of magnetic force or magnetic flux to extend through and concentrate at left and right ends of the ferrule's widened upper and lower walls 23*u* and 23*l*. Attractive forces applied by the magnets 30*l* and 30*r* to the exemplary paint can lip 44,45 are thereby laterally widened, advantageously providing additional stability to the paint brush 1 as it rests thereon.

A further structural component of the instant inventive paint brush 1 comprises a steel pry bar 18 which is securely mounted within the tailward end of the handle 2 so that an extreme tailward prying tip 20 of the pry bar 18 extends tailwardly therefrom. In the preferred embodiment, the tailward end of the handle 2 is configured to include a coffered section 6 which extends tailwardly from an annular step 10. The coffered section 6 is preferably fitted for nesting extension into the hollow opening 14 of the cap 12. The cap 12 advantageously covers and protects the tip 20 of the pry bar 18 while functionally serving as a tailward section of a paint brush handle. In the preferred embodiment, the interface between the coffered section 6 and the interior wall of the cap 12 forms a snap channel 16 and snap ridge 8 combination fastener for releasably holding the cap 12 upon the tailward end of the paint brush.

Figure 5:
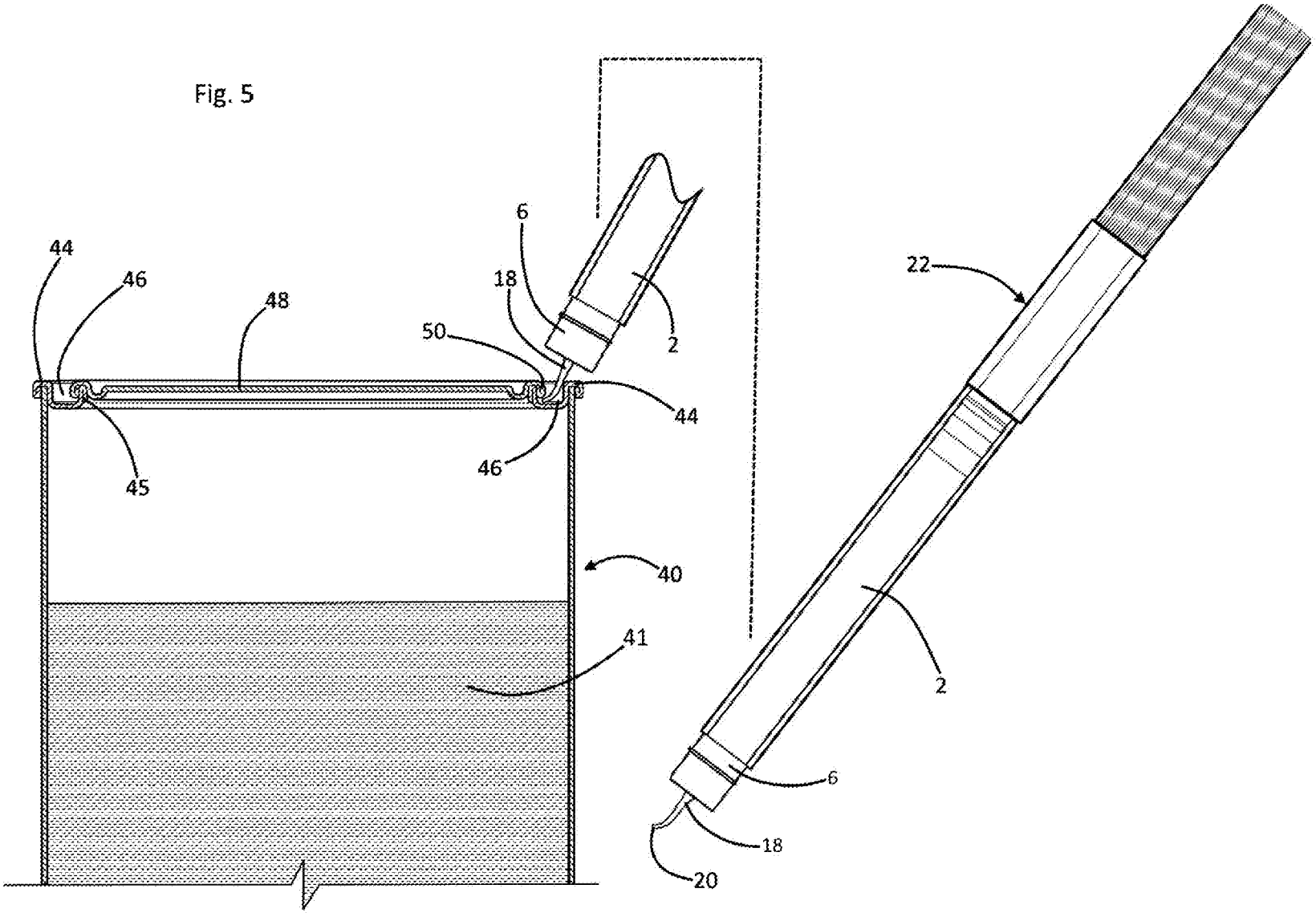
FIG. 5 shows the instant inventive paint brush in prying use upon a paint can having a closed lid.
Figure 6:
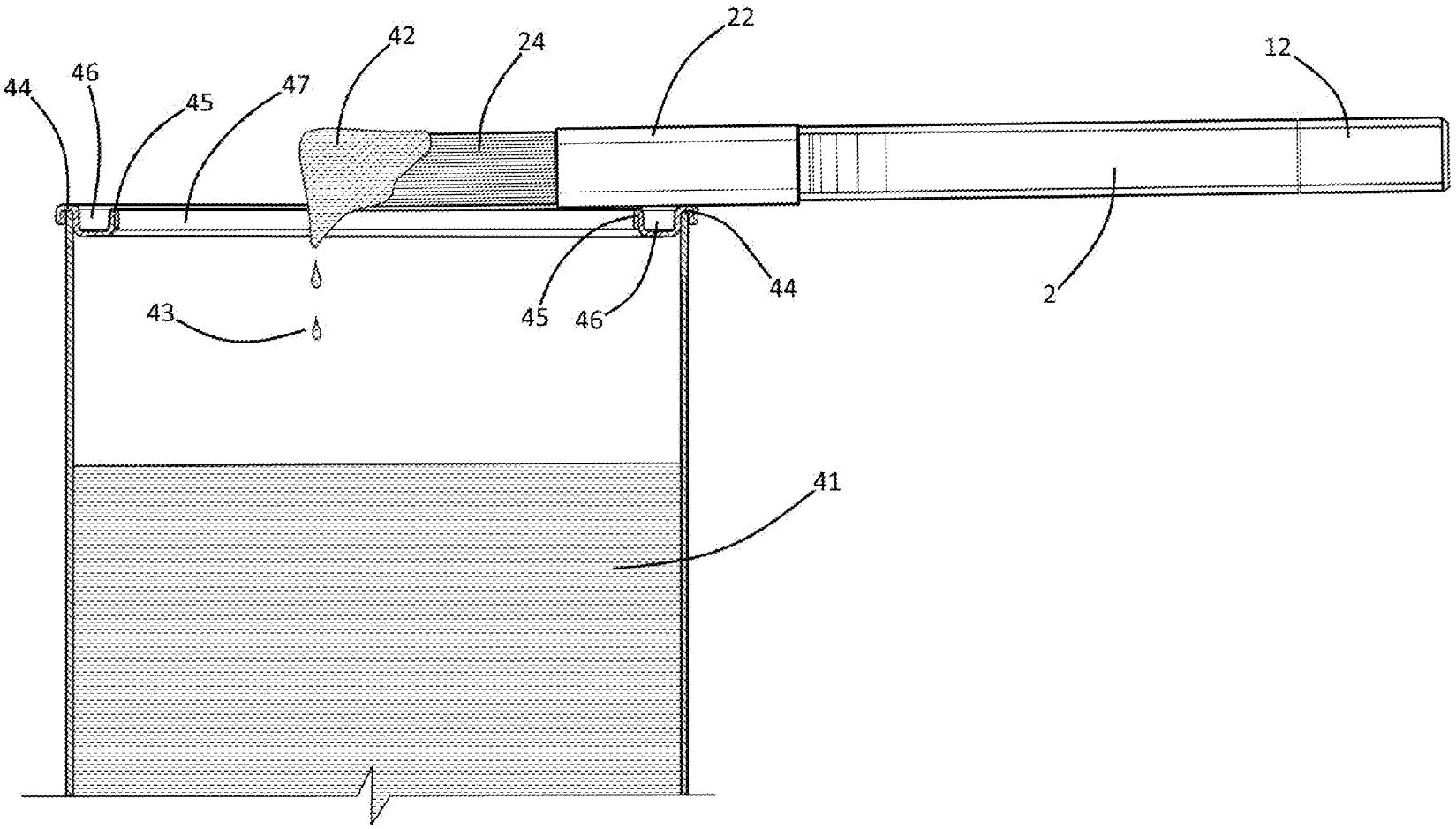
FIG. 6 shows the inventive paint brush alternatively resting against the lip of the paint can following opening of the paint can.

Referring simultaneously to FIGS. 1, 5, and 6, in use of the instant inventive paint brush 1, a painter may initially grasp the paint brush 1 by its handle 2 in one of his or her hands. Thereafter, the painter may grasp the cap 12 with the other hand and may pull tailwardly thereon, separating the cap 12 from the tailward end of the handle 2, as indicated in FIG. 5.

Thereafter, the painter may move and position the tailward end of the paint brush 1 so that the extreme tailward tip 20 of the pry bar 18 extends into a circular lid prying channel 46 of a paint can 40 containing a first body of paint 41, as indicated in FIG. 5. Such extension preferably positions the tip 20 of the pry bar 18 so that it immediately underlies the outer lip 50 of the paint can's lid 48, and so that an undersurface of the pry bar 18 contacts the concentric outer ridge 44 of the lid prying channel 46. Thereafter, the painter may lever the handle 2 downwardly and in the clockwise direction from the perspective of Drawing FIG. 5, such levering action counter-levering the tailward tip 20 of the pry bar 18 against the outer edge of the edge 50 of the lid 48. Such lid prying action advantageously releases the lid 48 from the can's opening 47. Following utilization of the paint brush 1 for prying lid removal, the cap 12 may be easily and conveniently snapped back into place as indicated in Drawing FIG. 6, such cap replacement protecting against any undesirable impingement of the tip 20 of the pry bar 18 against the palm of the painter's hand.

Such utilization of the inventive paint brush 1 for prying paint can lid advantageously alleviates or lessens any need on the part of the painter to set aside the paint brush to retrieve a separate prying tool. Where the bristles 24 of the paint brush 1 are loaded with a second body of wet paint 42 as indicated in Drawing FIG. 6, utilization of the paint brush 1 for lid prying and removal as indicated in 5 further advantageously eliminates any need to find a suitable temporary resting place for such paint loaded paint brush. The instant invention's provision of the cap 12 and the pry bar 18 advantageously allows the tail end of the handle to continuously perform an ergonomic hand contacting handle function while temporarily and alternatively functioning as a pry bar.

Referring simultaneously to FIGS. 3-6, painters often need to set aside a paint brush in order to free a hand to grasp another tool or item such as a paint scrapper or a wipe cloth. In such circumstances, it is often necessary for the painter to find a suitable location for temporary storage of the paint brush. The magnets **30*l* and 30*r* within the interior 28 of the ferrule 22 of the inventive paint brush 1 advantageously facilitate such painter's placement of the ferrule 22 in magnetic contact with the paint can's circular ridges 44 and 45 so that the handle 2 cantilevers outwardly from the paint can and away from opening 47, and so that the bristles 24 cantilever inwardly and toward the opening 47. Such inward cantilevering of the bristles advantageously causes bristles 24 to vertically overly the first body of paint 41. In the FIG. 6 configuration, the preferably high strength of the neodymium iron boron magnets 30*l* and 30*r* magnetically join with the typically steel composition of the paint can 40, advantageously holding the paint brush 1 in the horizontal channel 46 spanning configuration of FIG. 6. The combined attractive strengths of the magnets 30*l* and 30*r* hold the paint brush 1 at the FIG. 6 orientation regardless of any otherwise inwardly or outwardly over-balancing weight of the handle 2 or the wet bristles 24. While it is magnetically held in its FIG. 6 configuration and orientation, a third body of paint in the form of paint drippings 43 fall downwardly from the first body of paint 42 into the first body of paint 41. Accordingly, the instant inventive paint brush advantageously allows common opened paint cans such as can 40 to function as a resting place for temporary storage of the paint brush 1**.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A paint brush comprising:

(a) a handle having a head end and a tailward end;

(b) a ferrule fixedly attached to the handle, the ferrule having an interior space having a longitudinal midline;

(c) a body of bristles mounted within the ferrule;

(d) at least a first permanent magnet between the head end and the body of bristles, the at least first permanent magnet having a polar axis and being mounted within the ferrule's interior space; and (e) a second permanent magnet having a polar axis, wherein the at least first permanent magnet and the second permanent magnet are respectively positioned leftwardly and rightwardly from said longitudinal midline.

2. The paint brush of claim 1 wherein each magnet among the at least first permanent magnet and the second permanent magnet comprises a neodymium iron boron magnet.

3. The paint brush of claim 1 wherein the ferrule has laterally widened upper and lower walls, wherein the polar axis of the at least first permanent magnet extends through left ends of said walls, and wherein the polar axis of the second permanent magnet extends through right ends of said walls.

4. The paint brush of claim 3 wherein each magnet among the at least first permanent magnet and the second permanent magnet comprises a stacked magnet series.

5. The paint brush of claim 4 wherein each stacked magnet series arranges its magnetic poles in a "N, S, N, S, N, S . . . " pole series.

6. A paint brush comprising:

(a) a handle having a tailward end;

(b) a ferrule fixedly attached to the handle, the ferrule having an interior space;

(c) at least a first permanent magnet having a polar axis, the at least first permanent magnet being mounted within the ferrule's interior space;

(d) a body of bristles mounted within the ferrule;

(e) a pry bar fixedly attached to the handle, the pry bar extending from the handle's tailward end; and (f) a cap fitted for covering pry bar, the cap being adapted for removable attachment to the handle's tailward end.

7. The paint brush of claim 6 wherein the tailward end of the handle comprises a coffered section, and wherein the adaptation of the cap for removable attachment to the tailward end of the handle comprises a fitting of the cap for nesting receipt of said coffered section.

8. The paint brush of claim 7 wherein the adaptation of the cap for removable attachment to the tailward end of the handle further comprises a snap ridge and snap channel fastener.

9. An assembly for temporary paint brush storage comprising:

(a) a steel paint can having an upper lip, said lip defining an upper opening;

(b) a first body of paint contained within the paint can;

(c) a paint brush ferrule, said ferrule receiving and oppositely extending a handle and a body of bristles;

(d) at least a first permanent magnet mounted within the ferrule, said magnet holding the ferrule upon the paint can's upper lip so that the opposite extensions of the handle and the body of bristles respectively cantilever the handle and the body of bristles away from and toward the upper opening;

(e) a second body of paint, the second body of paint being loaded within the body of bristles; and (f) third bodies of paint comprising drippings from the second body of paint, said drippings falling downwardly into the first body of paint.

10. The assembly of claim 9 further comprising a second permanent magnet, wherein the ferrule has a laterally widened interior space, wherein the at least first permanent magnet is positioned leftwardly within said space, and wherein the second permanent magnet is positioned rightwardly within said space.

* * * * *